US007811026B1

(12) United States Patent
Kulp et al.

(10) Patent No.: US 7,811,026 B1
(45) **Date of Patent: *Oct. 12, 2010**

(54) SUPPORT BASE FOR FLEXIBLE MARKER DEVICE

(75) Inventors: Jack H. Kulp, Dana Point, CA (US); Geoffrey B. Maus, Mission Viejo, CA (US); Felipe Almanza, Perris, CA (US)

(73) Assignee: TrafFix Devices, Inc., San Clemente, CA (US)

( * ) Notice: Subject to any disclaimer, the term of this patent is extended or adjusted under 35 U.S.C. 154(b) by 525 days.

This patent is subject to a terminal disclaimer.

(21) Appl. No.: 11/935,338

(22) Filed: Nov. 5, 2007

Related U.S. Application Data

(60) Provisional application No. 60/856,519, filed on Nov. 3, 2006.

(51) Int. Cl.
*E01F 9/012* (2006.01)

(52) U.S. Cl. ..... 404/10; 116/63 C

(58) Field of Classification Search ..... 40/607.06, 40/607.1, 608, 612; 116/63 C, 63 P; 404/9, 404/10, 73

See application file for complete search history.

(56) References Cited

U.S. PATENT DOCUMENTS

| | | | | |
|---|---|---|---|---|
| 1,939,968 | A * | 12/1933 | Frei, Jr. | 52/113 |
| 3,618,556 | A | 11/1971 | Dittrich | |
| 4,197,807 | A * | 4/1980 | Campbell | 116/63 P |
| 4,611,949 | A | 9/1986 | Schmanski | |
| 5,026,204 | A | 6/1991 | Kulp et al. | |
| 5,305,705 | A * | 4/1994 | Gagliano | 116/63 P |
| 5,375,554 | A * | 12/1994 | Yen | 116/63 C |
| 5,468,093 | A | 11/1995 | Voigt | |
| 5,488,792 | A * | 2/1996 | Kwok | 40/612 |
| 5,560,732 | A | 10/1996 | Kulp et al. | |
| 5,732,911 | A | 3/1998 | Kulp et al. | |
| 5,755,528 | A | 5/1998 | Kulp et al. | |
| 6,019,543 | A | 2/2000 | Junker | |
| 6,402,422 | B1 | 6/2002 | Gertz et al. | |
| 6,712,547 | B1 | 3/2004 | Shauf, Sr. et al. | |
| 6,766,760 | B2 | 7/2004 | Garcia | |
| 6,840,707 | B1 | 1/2005 | Kulp et al. | |
| 6,928,952 | B2 * | 8/2005 | Garcia | 116/63 C |
| 7,056,055 | B1 | 6/2006 | Kuo | |
| 7,228,813 | B2 | 6/2007 | Flamingo et al. | |
| 7,677,831 | B2 * | 3/2010 | Kulp et al. | 404/10 |
| 7,731,449 | B2 * | 6/2010 | Kulp et al. | 404/72 |
| 2002/0073912 | A1 | 6/2002 | Kuo | |

(Continued)

OTHER PUBLICATIONS

International Search Report and Written Opinion for related PCT Application No. PCT/US07/16577.

*Primary Examiner*—Gary S Hartmann
(74) *Attorney, Agent, or Firm*—Stout, Uxa, Buyan & Mullins, LLP; Donald E. Stout

(57) ABSTRACT

A flexible marker device comprises a marker body having a bottom end and a top end, and a base for supporting the marker body. The base has an aperture in a center portion thereof and a cavity extending about the aperture in an upper surface of the base. The bottom end of the marker body is at least partially disposed within the cavity, which has a segmented cog shape. A cured material, preferably urethane, is disposed in the cavity to thereby secure the marker body to the base.

18 Claims, 5 Drawing Sheets

U.S. PATENT DOCUMENTS

| | | | |
|---|---|---|---|
| 2004/0146677 | A1 | 7/2004 | Boyd |
| 2004/0237875 | A1 | 12/2004 | Garcia |
| 2005/0076822 | A1 | 4/2005 | Levine |
| 2006/0016383 | A1 | 1/2006 | Flamingo et al. |
| 2006/0093432 | A1 | 5/2006 | Burlando |
| 2007/0113774 | A1 | 5/2007 | Kuo |

* cited by examiner

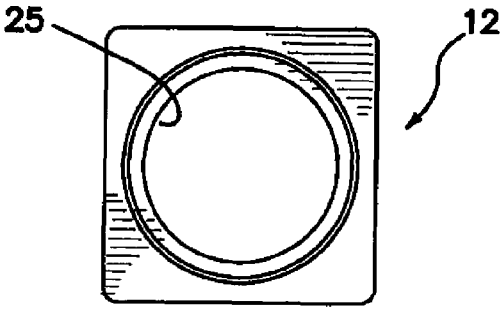
FIG. 5
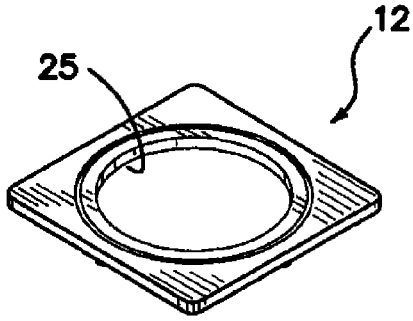
FIG. 6
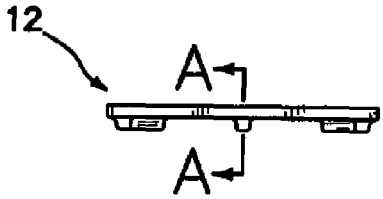
FIG. 7
FIG. 10
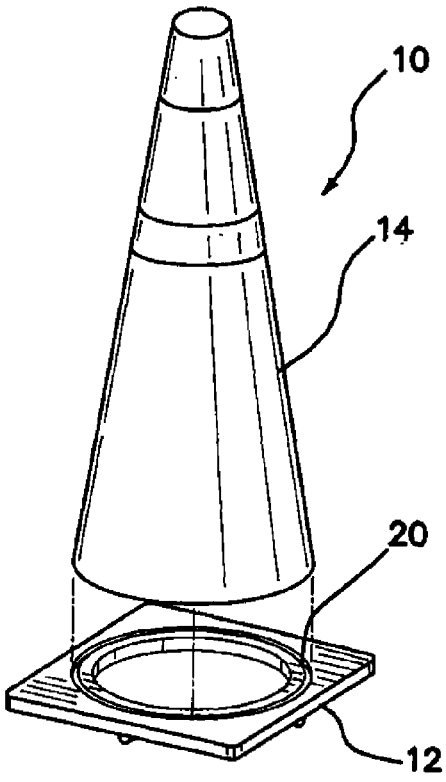
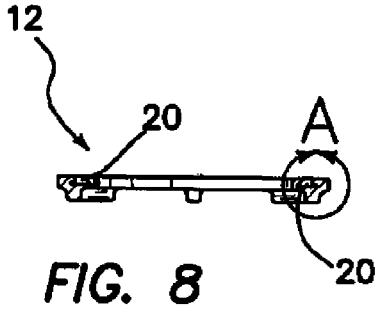
FIG. 8
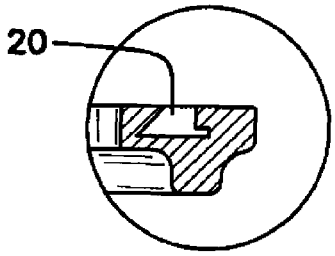
FIG. 9

SUPPORT BASE FOR FLEXIBLE MARKER DEVICE

This application claims the benefit under 35 U.S.C. 119(e) of the filing date of Provisional U.S. Application Ser. No. 60/856,519, entitled Flexible Marker Base, filed on Nov. 3, 2006. This provisional application is expressly incorporated herein by reference. This application is also related to co-pending U.S. application Ser. No. 11/880,865, entitled Flexible Marker Device, filed on Jul. 24, 2007 and commonly assigned herewith. This application is also expressly incorporated herein by reference.

BACKGROUND OF THE INVENTION

The present invention relates generally to traffic marker devices or safety cones used to alert or divert vehicles, pedestrians, and the like, and more particularly to a support base for a flexible marker safety device which self-positions to its original configuration, deviates from its original configuration due to natural or traffic-caused perturbations, and is restored to its original configuration from a deviated position in the event the aforementioned perturbations abate.

A traffic marker device of the type contemplated herein is disclosed in U.S. Pat. No. 6,766,760 to Garcia, which patent is herein expressly incorporated by reference. The safety cone disclosed in the Garcia '760 patent is highly utilitarian. However, one of the most difficult aspects of manufacturing such a device is the connection between the bottom part 142 of the marker portion 140, which comprises a conically shaped spring, as shown, and the base 110.

In one prior art approach, the base of such a marker device is molded of polyurethane or the like, and injection molded clips are utilized to attach the base end of the marker to a ring molded in the base. This is a relatively expensive product, because of the cost of polyurethane, plus the cost of the ring and the three clips, and because it is labor intensive.

What is needed is an improved, inexpensive, and easy to manufacture approach for connecting the body and the base of a flexible marker device of the type disclosed.

SUMMARY OF THE INVENTION

The present invention addresses the problems noted above by providing an inventive flexible marker device and method of producing same which permits one to avoid the use of expensive polyurethane for fabricating the entire base, thus avoiding substantial costs, while still permitting a superior attachment of the flexible marker body to the base. No mechanical fasteners are required, thus reducing labor requirements substantially.

More particularly, there is provided a flexible marker device, which comprises a marker body having a bottom end and a top end, and a base for supporting the marker body. The base has an aperture in a center portion thereof and a cavity extending about the aperture in an upper surface of the base. Preferably, the cavity has a segmented cog shape.

The base is preferably comprised of molded vulcanized rubber, but may alternatively be molded of crumb (recycled) rubber, or other suitable materials.

The bottom end of the marker body is at least partially disposed within the cavity. A cured material, preferably urethane, is disposed in the cavity to thereby secure the marker body to the base. Preferably, the cured material substantially fills the cavity.

In a preferred embodiment, the marker body comprises a flexible skeleton and a flexible cover disposed over the skeleton. The flexible skeleton preferably comprises a length of flexible material formed in a coil and thus comprising a spring, including a bottom coil which comprises the bottom end of the marker body which is at least partially disposed within the cavity. The flexible cover comprises a mesh material having a plurality of small apertures therein, a bottom portion of the mesh material also extending downwardly into the cavity.

An advantageous feature of the present invention is that some of the cured material extends through the mesh material, thus assisting in securing the marker body to the base. Also, because the cavity is preferably shaped so that an upper portion thereof is narrower than a lower portion thereof, whereby portions of the base which define the groove converge toward one another in an upward direction, the bottom end of the marker body which is disposed within the cavity is at least partially constrained from exiting the cavity by the converging portions of the base. The cured material preferably is formed into the same segmented cog shape as that of the cavity.

In another aspect of the invention, there is disclosed a method of manufacturing a flexible marker device, which comprises steps of providing a base having a cavity molded therein and placing a bottom end of a marker body in the cavity. Additional method steps include pouring a liquid material, preferably urethane, into the cavity, as well as curing the liquid material to harden same, in order to secure the marker body bottom end in the cavity.

Preferably, the marker body comprises a flexible skeleton having a bottom coil and a cover disposed over the flexible skeleton, wherein the cover comprises a mesh material. The bottom coil is disposed in the cavity during the placing step. More preferably, a portion of the mesh cover also extends into the cavity. In such case, the pouring step comprises pouring the liquid material through the mesh material, so that when the liquid material is cured, it extends through the mesh material and functions to help secure the marker body to the base.

In preferred methods, the aforementioned providing step includes a step of molding the cavity into the base so that portions of the base defining the cavity taper toward an upper opening of the cavity. The placing step preferably comprises disposing the marker body bottom end beneath the tapered cavity portion to help retain the marker body bottom end within the cavity. Most preferably, the cavity shape comprises a shape resembling a segmented cog.

The invention, together with additional features and advantages thereof, may best be understood by reference to the following description taken in conjunction with the accompanying illustrative drawing.

BRIEF DESCRIPTION OF THE DRAWINGS

FIG. 5 is a top view of a base for a flexible marker constructed in accordance with the principles of the present invention;

FIG. 6 is a perspective view of the base illustrated in FIG. 5;

FIG. 7 is a side view of the base illustrated in FIGS. 5 and 6;

FIG. 8 is a cross-sectional view taken along lines A-A of FIG. 7;

FIG. 9 is a detail cross-sectional view of the portion of FIG. 8 denoted by the circle A;

FIG. 10 is a perspective view of a combination of a flexible marker assembled with a base as shown in FIGS. 5-9;

DESCRIPTION OF THE PREFERRED EMBODIMENT

Figure 1:
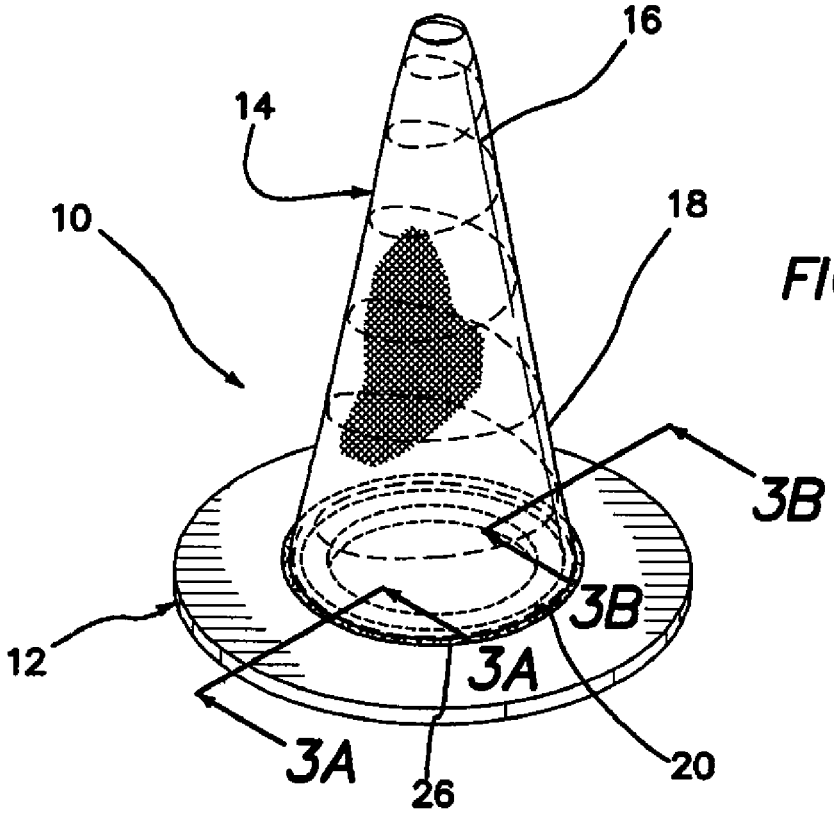
FIG. 1 is a perspective view of an embodiment of a flexible marker according to the invention.

Referring now more particularly to the drawings, there is shown in FIG. 1 a flexible marker device 10 comprising a base 12 and a marker body 14. The marker body 14 may be constructed in a manner similar to that disclosed in the Garcia '760 patent, comprising a flexible skeleton 16 over which is disposed a flexible cover 18. The flexible skeleton 16 is preferably comprised of a length of flexible metal, such as steel, formed in a coil and thus comprising a spring, wherein the flexible metal may be either round or flat stock. Other marker body shapes, and other materials may be utilized as well, within the scope of the invention.

Figure 2:
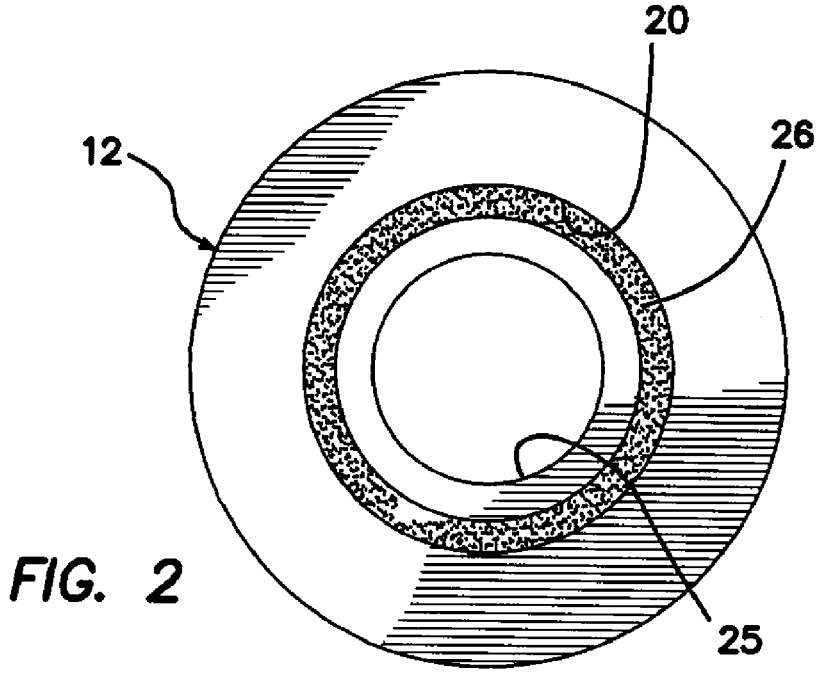
FIG. 2 is a top view of one embodiment showing details of the base and marker construction.
Figure 3A:
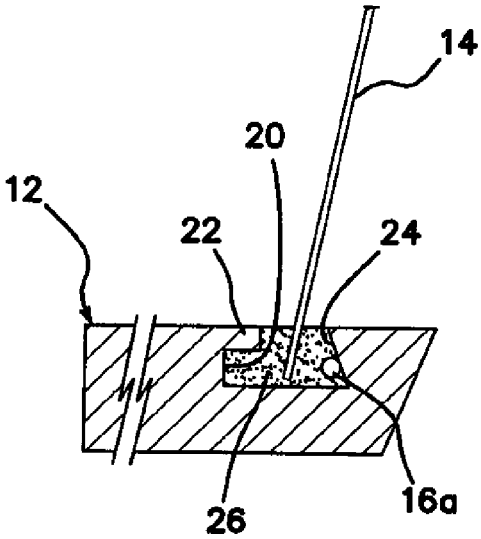
FIG. 3A is a cross-sectional view along lines 3A-3A of FIG. 1, showing particular details of the connection between the base and the marker of the invention.
Figure 3B:
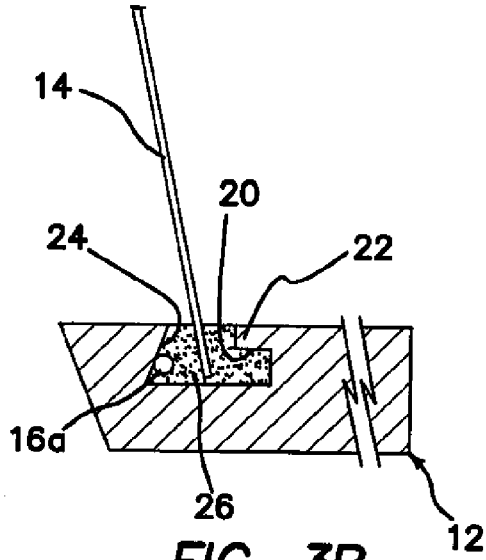
FIG. 3B is a cross-sectional view along lines 3B-3B of FIG. 1, showing details similar to those shown in FIG. 3A, along a different portion of the connection between the base and the marker of the invention.

Now referring, as well, to FIGS. 2, 3A, and 3B, the base 12 preferably comprises molded vulcanized rubber throughout most of its volume. It may also be comprised of non-vulcanized scrap or crumb rubber, for example, or other suitable material. The base may be round, as shown, square, or any other desired shape, such as the shape shown for base 12 in FIG. 4. In one embodiment, the base is designed to have a molded weight of approximately 3 to 3½ pounds. The base includes a molded groove 20 which is uniquely shaped, as shown, as a sort of "cog wheel" or "gear tooth design", so that the groove is defined, in part, by an overhanging portion 22 and a wedge-shaped tapering portion or ledge 24. The purpose of the groove 20 is to receive and retain a bottom coil 16*a* of the flexible skeleton 16. Preferably, the bottom coil 16*a* is disposed within the groove 20 so that it lies beneath the ledge 24, as shown in FIGS. 3A and 3B. In the center of the base is disposed an aperture or opening 25. This aperture or opening 25 is particularly adapted for receiving a top end of a second marker device for the purpose of stacking a plurality of the marker devices for transport or storage, as is known in the art.

In one particular embodiment, the groove 20 is molded to a depth of about ⅜ inches, and is disposed radially about 11½ inches from the center of the base. The ledge 24 overhangs the groove 20 by a distance of about ⅞ inches. Of course, these dimensions, as well as other particular design features, may be changed as appropriate within the scope of the present invention.

Once the marker device 10 is assembled, as shown in FIG. 3, polyurethane 26 is poured into the groove 20 until it is substantially filled, as shown in FIGS. 1-3B. The polyurethane is then permitted to air dry in order to cure and to seal the coil 16*a* within the groove. Suitable alternatives to polyurethane may be used instead.

Figure 4:
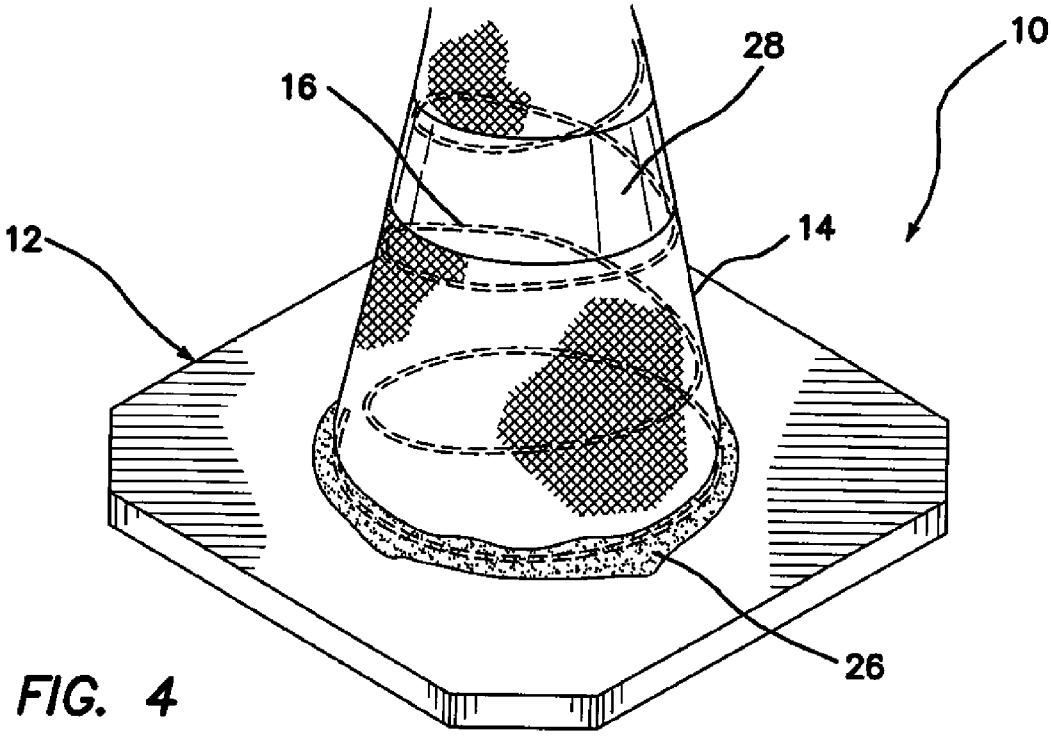
FIG. 4 is a perspective view of a modified embodiment of the invention, illustrating that the cone body is formed of a mesh material, and that the base may be comprised of an alternate shape.
Figure 11:
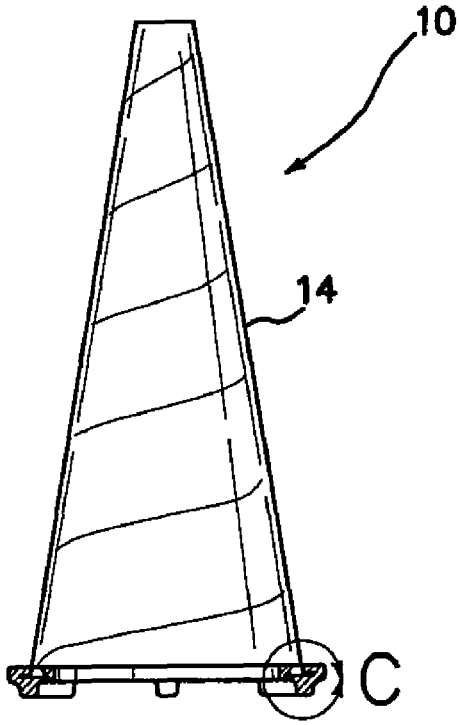
FIG. 11 is a side view of the assembled flexible marker and base shown in FIG. 10.

As shown in FIG. 4, the body 14 of the marker is preferably fabricated from a mesh material, either fabric or plastic. Reflective stripes 28 may be disposed on the body 14 at any desired location, as is well known in the art.

In the preferred method of the present invention, as noted above, the bottom portion of the marker device 10, including the bottom coil 16*a* of the flexible skeleton 16, is placed within the groove. Once in place, as shown particularly in FIGS. 3A and 3B, the molten polyurethane is poured into the groove 20 so that it goes through the mesh wall of the marker body 14. Thus, as the polyurethane hardens during the curing process, it is intertwined within the apertures of the mesh wall, so that an additional connection between the marker body and the base is created. As shown in FIG. 4, the cured polyurethane substantially fills the groove, and, in fact, may flow out and over surrounding portions of the base.

Advantages of the present invention include, but are not necessarily limited to, the following:

1) the coil 16*a* is secured within the base in two ways—both by the cured polyurethane, and because it is disposed beneath the ledge 24, and thus held in place thereby;

2) no mechanical fasteners are required;

3) labor costs are much reduced;

4) Use of rubber, rather than solid polyurethane throughout, greatly reduces material costs, since the per pound cost of polyurethane is presently about three to four times the per pound cost of rubber. However, the use of polyurethane in the groove 20 still permits one to take advantage of the superior retention characteristics of polyurethane relative to vulcanized rubber; and 5) The engagement of the polyurethane and the mesh walls of the marker body, as described above, provides an additional securement of the marker body and the base without the use of mechanical fasteners.

Now with reference to FIGS. 5-16, additional unique features of the present invention are illustrated. A base 12 is shown in FIGS. 5-9, and is preferably fabricated of a combination of recycled and vulcanized crumb rubber and polyurethane resin. In a preferred embodiment, the base 12 has overall dimensions of 1¼ inches×14 inches×14 inches, and weights approximately 4.5 lbs. When combined with the top flexible marker body 14 (FIG. 10), the total weight of the flexible marker device 10 is approximately 5 lbs.

Figure 12:
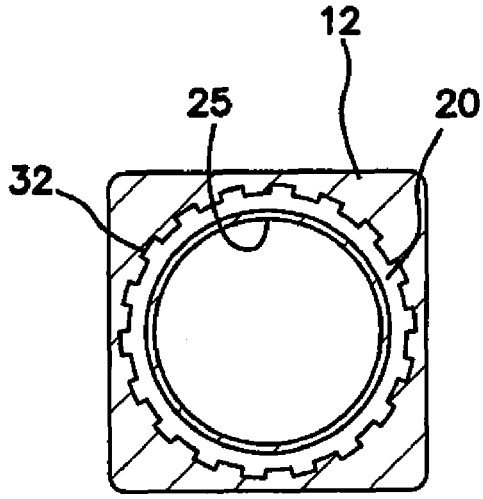
FIG. 12 is a top view of the base of FIG. 5 showing a unique cog-shaped cavity in the base.

When initially fabricated, the base 12 can be made entirely from recycled crumb rubber, or, alternatively, from a combination of recycled crumb rubber and vulcanized rubber. Within the base design, a cavity or groove 20 is made through a distance spanning 360° about the center axis of the base, as shown. If seen from a top cut away view, such as is illustrated in FIG. 12, it is clear that the cavity 20 preferably has a shape resembling a radial segmented cog. The cavity 20 is designed to hold 360° of the bottom spring coil 16*a* of the flexible marker within the cavity, but is not designed to provide any permanent locking ability by itself.

Figure 13:
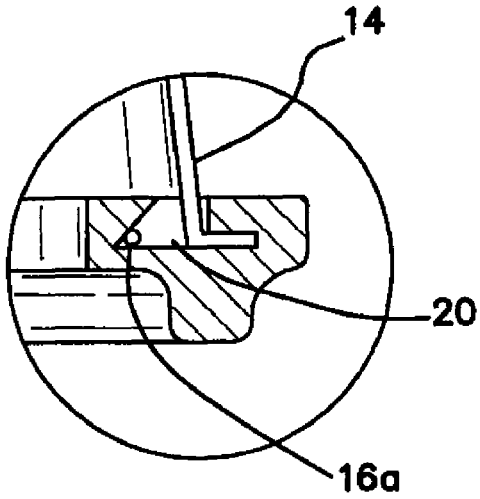
FIG. 13 is a detail view of the portion of FIG. 11 denoted by the circle C.
Figure 14:
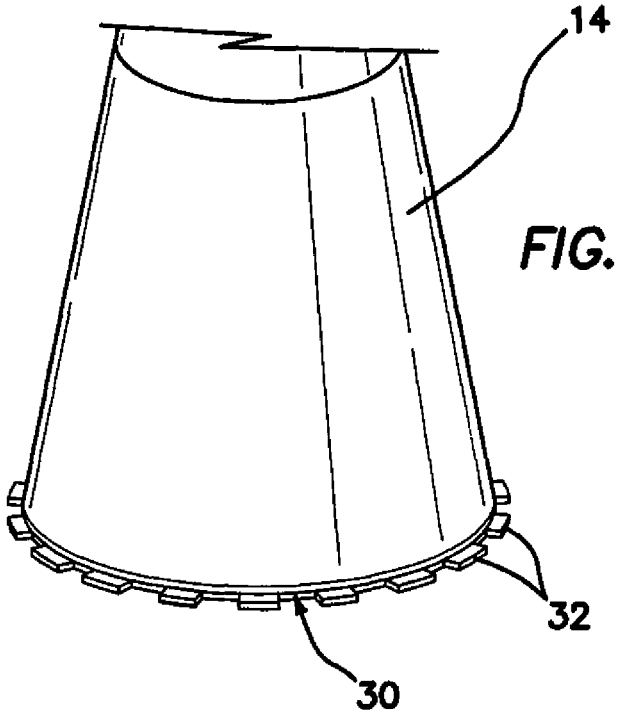
FIG. 14 is a perspective view of a lower portion of the flexible marker of FIGS. 10 and 11.

To permanently lock the spring inside the base cavity 20, a liquid polyurethane resin is poured into the cavity, atop and around the previously inserted bottom spring coil 16*a*. The radial segmented cog shape of the cavity is designed to provide optimum permanent locking for the spring coil within the cavity. When the spring is placed into the cavity 20, the bottom coil 16*a* is stretched into position at the bottom of a dove tail shape as seen in FIG. 13. As discussed above, because the bottom coil is disposed in the bottom of the dove tail, the coil would be required to move up and against the angled surface to come out of the cavity. Once the bottom coil 16*a* is set into the bottom of the dove tail, a second process is performed to assure that the flexible marker (preferably a spring cone, as discussed above) is securely and permanently attached to the base.

A liquid urethane resin is poured into the flexible marker base cavity 20, to complete this second process. The liquid urethane encapsulates the bottom spring coil, cone mesh sleeve material, and fills the cavity all at the same time as shown in FIGS. 12 and 13. In a preferred method, the liquid resin is a two part mixture of urethane and catalyst which is stored in separate containers until production is needed. The resin is mixed together in a pre-set machine which mixes the proper urethane ratio and pumps the resin into the cavity 20.

Figure 15:
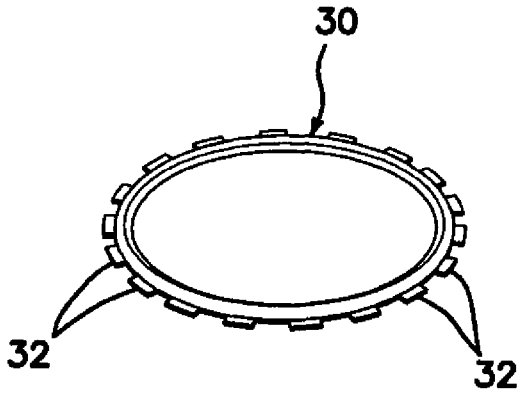
FIG. 15 is a perspective view of hardened urethane used in manufacturing the flexible marker and base combination of the present invention.
Figure 16:
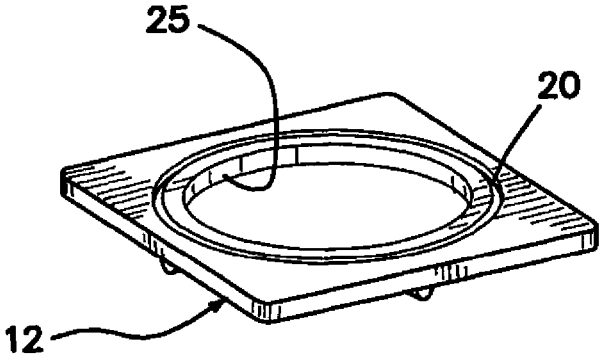
FIG. 16 is a perspective view of the base of the present invention.

When the resin is initially pumped into the cavity, it is in a liquid form and will begin to gel. Within two minutes, the resin will ultimately harden completely. The urethane resin does not adhere to the rubber side or top walls within the cavity 20. Instead, the cavity shape is designed into the rubber base, permitting the liquid resin to form into a radial segmented cog shape 30 (FIG. 15). Once the urethane has completely gelled to a hardened piece, the radial cog-shaped urethane is now mechanically locked under the cavity's upper face, as seen in FIG. 13.

Each cog tooth 32 represents a mechanically locked spot on the urethane shaped cog, as seen in FIG. 13. The urethane completely covers the bottom spring coil 16*a* and the attached spring cone material. By covering the bottom coil 16*a* of the spring in the base cavity with the urethane, mechanical locking of the spring cone and the 360° wrap of the spring cone material about the last coil is permanently achieved. The encapsulated bottom spring and cone material is then mechanically locked into the cavity as a result of the radial segmented cog-shaped cavity design. In order to separate the spring cone from the base, the hardened urethane would have to be forced out from the tapered walls facing each other. The most difficult part would be removing the part of the urethane tooth shape from the base, as seen in FIG. 13.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A flexible marker device, comprising:

a marker body having a bottom end and a top end;

a base for supporting said marker body, said base having an aperture in a center portion thereof and a cavity extending about said aperture in an upper surface of the base, said cavity having a segmented cog shape;

the bottom end of said marker body being at least partially disposed within said cavity;

a cured material, formed in said segmented cog shape, disposed in said cavity to thereby secure said marker body to said base.

2. The flexible marker device as recited in claim 1, wherein said marker body comprises a flexible skeleton and a flexible cover disposed over said skeleton.

3. The flexible marker device as recited in claim 2, wherein said flexible skeleton comprises a length of flexible material formed in a coil and thus comprising a spring, including a bottom coil which comprises the bottom end of said marker body which is at least partially disposed within said cavity.

4. The flexible marker device as recited in claim 3, wherein said flexible cover comprises a mesh material having a plurality of small apertures therein, a bottom portion of said mesh material also extending downwardly into said cavity.

5. The flexible marker device as recited in claim 4, wherein some of the cured material extends through the mesh material, thus assisting in securing the marker body to the base.

6. The flexible marker device as recited in claim 1, wherein said bottom end of said marker body which is disposed within said cavity is at least partially constrained from exiting the cavity by converging portions of the base which define portions of the cavity.

7. The flexible marker device as recited in claim 1, wherein said cured material comprises urethane.

8. The flexible marker device as recited in claim 1, wherein said base comprises rubber.

9. The flexible marker device as recited in claim 1, wherein said cured material substantially fills said cavity.

10. A method of manufacturing a flexible marker device, comprising:

providing a base having a cavity molded therein, wherein the cavity has a shape resembling a segmented cog;

placing a bottom end of a marker body in said cavity;

pouring a liquid material into said cavity; and curing said liquid material to harden same, in order to secure said marker body bottom end in said cavity.

11. The method as recited in claim 10, wherein said marker body comprises a flexible skeleton having a bottom coil and a cover disposed over said flexible skeleton, said cover comprising a mesh material.

12. The method as recited in claim 11, wherein said bottom coil is disposed in said cavity during said placing step.

13. The method as recited in claim 12, wherein a portion of said mesh cover also extends into said cavity.

14. The method as recited in claim 13, wherein said pouring step comprises pouring said liquid material through said mesh material, so that when the liquid material is cured, it extends through the mesh material and functions to help secure the marker body to the base.

15. The method as recited in claim 10, wherein said liquid material comprises urethane.

16. The method as recited in claim 10, wherein said providing step includes a step of molding said cavity into said base so that portions of said base defining said cavity taper toward an upper opening of the cavity.

17. The method as recited in claim 16, wherein said placing step comprises disposing said marker body bottom end beneath said tapered cavity portion to help retain the marker body bottom end within said cavity.

18. The method as recited in claim 10, wherein said pouring step comprises a step of mixing together a urethane and a catalyst in a proper ratio, and then delivering the resin mixture into said cavity.

* * * * *